United States Patent [19]

Wallevik et al.

[11] 4,385,931

[45] May 31, 1983

[54] METHOD AND FURNACE FOR REFINING OF MAGNESIUM

[75] Inventors: Oddmund Wallevik; Jan B. Ronhaug, both of Porsgrunn, Norway

[73] Assignee: Norsk Hydro a.s., Oslo, Norway

[21] Appl. No.: 316,421

[22] Filed: Oct. 29, 1981

[30] Foreign Application Priority Data

Dec. 17, 1980 [NO] Norway ..... 803804

[51] Int. Cl.[3] ..... C22B 26/22

[52] U.S. Cl. ..... 75/67 A; 75/10 R; 266/215; 266/229; 373/121

[58] Field of Search ..... 75/67 R, 67 A, 10 R, 75/63, 93 R, 93 AB; 266/201, 215, 229, 205; 373/121

[56] References Cited

U.S. PATENT DOCUMENTS 2,150,437 3/1939 Gilbert ..... 75/67 A
2,787,592 4/1957 Burkhardt ..... 75/67 A
3,882,261 5/1975 Kosarev et al. ..... 75/10 R

FOREIGN PATENT DOCUMENTS 643325 6/1962 Canada ..... 266/215

*Primary Examiner*—M. J. Andrews
*Attorney, Agent, or Firm*—Wenderoth, Lind & Ponack

[57] ABSTRACT

Raw magnesium is charged into a precipitation chamber in a refining furnace beneath the metal surface as a stream directed toward a salt layer beneath the metal. The resultant precipitated sludge is directed along a sloped bottom in the chamber to an adjacent accumulating chamber. Magnesium rises in the precipitation chamber and passes through openings in partition walls between adjacent precipitation chambers. The purest magnesium from an upper metal layer in one chamber is expelled to a lower level in next chamber in the process direction. The refining furnace comprises an accumulating chamber for sludge and plurality of successively arranged precipitation chambers divided from each other by vertical walls. The openings in the partition walls between adjacent precipitation chambers are designed as skewed channels with an inlet at a higher level than an outlet in the following chamber.

9 Claims, 2 Drawing Figures

METHOD AND FURNACE FOR REFINING OF MAGNESIUM

BACKGROUND OF THE INVENTION

The invention relates to an improved method for the continuous refining of magnesium by the precipitation of impurities in the form of sludge and to a refining furnace for performance of the method.

Most magnesium-refining today is done discontinuously in crucibles placed under lids in suitable electric furnaces. After a certain period of time impurities are separated from the magnesium by settling as a sludge in the bottom of the crucible. The refined magnesium collects in the upper part of the crucible and is decanted, and the crucible then is cleaned of sludge prior to the next use. This method is characterized by low productivity, high energy consumption and metal losses caused by metal oxidation. Furthermore, this method results in unpleasant working conditions for the operators exposed to heat and gases from the melt.

There is a known construction principle for a continuously operating refining furnace. Such a furnace comprises a rectangular refractory lined body, divided by means of vertical partition walls into several chambers. Raw magnesium is continuously charged into the first chamber and passes through openings in the partition walls, provided at a level corresponding to the metal level in the furnace, and the metal is transferred successively from one chamber to the next. The sludge and the salt melt one gradually precipitated in the individual chambers and accumulated in the bottoms of the chambers. The purified magnesium is discharged from the last (successive) chamber. The furnace is provided with a lid which has openings for charging/discharging of magnesium and for the removal of the sludge from the individual chambers. A protective gas is fed into the chambers in order to avoid metal oxidation.

However, in spite of the obvious advantages compared with the discontinuous crucible refining, even this construction is not quite satisfactory. The capacity of such furnaces is limited and the accumulated sludge has to be removed individually from each chamber. The furnace therefore has to be regularly shut down for the discharge of the sludge. Through openings in the furnace lid, both the protective gas and the fumes from the melt are released to the atmosphere, and air entering the chambers oxidizes some of the magnesium. Besides, the sludge discharge operation results in a considerable heat loss from the furnace.

U.S. Pat. No. 3,882,261 describes another type of furnace for continuously refining magnesium. The furnace, which is cylindrically shaped, is divided by means of vertical partition walls into a central chamber and peripheral chambers surrounding the central chamber. The partition walls between the peripheral chambers are provided with openings for the transfer of the charged metal from one chamber to the next in the direction of the refining process, with the gradual precipitation of sludge in the chambers. The central chamber, which is closed at its upper part by the furnace lid and separated in this way from the peripheral chambers, receives only the bath melt and no magnesium. The furnace bottom is provided with sloped walls enabling the sludge from the peripheral chambers to accumulate in the bottom of the central chamber.

This construction theoretically provides a furnace with a centralized sludge discharge where it is not necessary to interrupt the refining process, since the peripheral chambers with magnesium remain closed during the removal of sludge. However, there is a strong probability that a part of the sludge will also accumulate in the peripheral chambers, and such sludge has to be periodically removed. Furthermore the patent states that in order to achieve a productivity of 80–100 t/day the furnace capacity has to be 30–35 $m^3$.

The relatively high current velocities between the peripheral chambers make it necessary to provide such large furnace volume to achieve a sufficient treatment time in order to obtain the required purification grade of the metal. The furnace is very deep, which is unfavourable both from the construction point of view and with regard to the insertion of the device for removal of the sludge. Besides the high capital and operating costs, the furnace represents a safety risk for the operators during the possible leakage of such a mass of liquid magnesium. Accordingly, the object of the present invention is to overcome the above mentioned difficulties.

SUMMARY OF THE INVENTION

The principal object the present invention is to provide a method and a furnace for refining of magnesium, which ensure a high productivity at low capital and operating costs and a minimal oxidation loss of the refined magnesium.

The invention is based upon a realization of the fact that the sludge consists actually of two components featuring different physical properties. Most of the sludge, which accumulates in the bottom of the tapping and transport crucible as a heavy floating mass, is a mixture of salt melt and fine oxide particles. The other type of the sludge consists of coarser oxide particles formed during the transfer or treatment of the metal. These particles, consisting mainly of the magnesia (MgO), have a high angle of repose, and during precipitation in the refining furnace a nearly vertical piling of this sludge will take place in the chambers. A common drawback for the above mentioned refining furnaces is the fact that their constructions do not allow an effective separation of these two sludge types from each other.

The main object of the invention is achieved by bringing the metal to be refined under the metal surface in a first of several consecutively arranged precipitation chambers as a stream directed toward a sub-laying salt layer, the precipitated sludge being so forced along a sloped bottom to an adjacent accumulating chamber, and the metal rising in the precipitation chamber and expelling metal from an upper layer through one or more openings in the partitions wall to the next precipitation chamber at a level which is lower than the inlet opening in the partition wall between these two chambers.

The invention relates further on to a refining furnace for performance of the method according to the invention. The refining furnace comprises a refractory lined body divided by means of the partition walls into a chamber for the accumulation of the sludge and several consecutively arranged precipitation chambers, the partition walls between the precipitation chambers being provided with openings for a successive transfer of the metal through the chambers.

The refining furnace is especially characterized in that the first precipitation chamber, into which the magnesium is charged, is provided with a sloped bottom sloping in direction toward the adjacent accumulating chamber, and that the openings in the partition walls between the precipitation chambers are designed as skewed channels with an inlet at a level higher than the outlet in the following successive chamber in the process direction.

BRIEF DESCRIPTION OF THE DRAWINGS

The invention will be described in more detail in connection with an exemplary embodiment of a refining furnace, which is especially suited for the performance of continuous refining of magnesium according to the invention with reference to the accompanying drawings wherein.

DETAILED DESCRIPTION OF THE DRAWINGS

Figure 1:
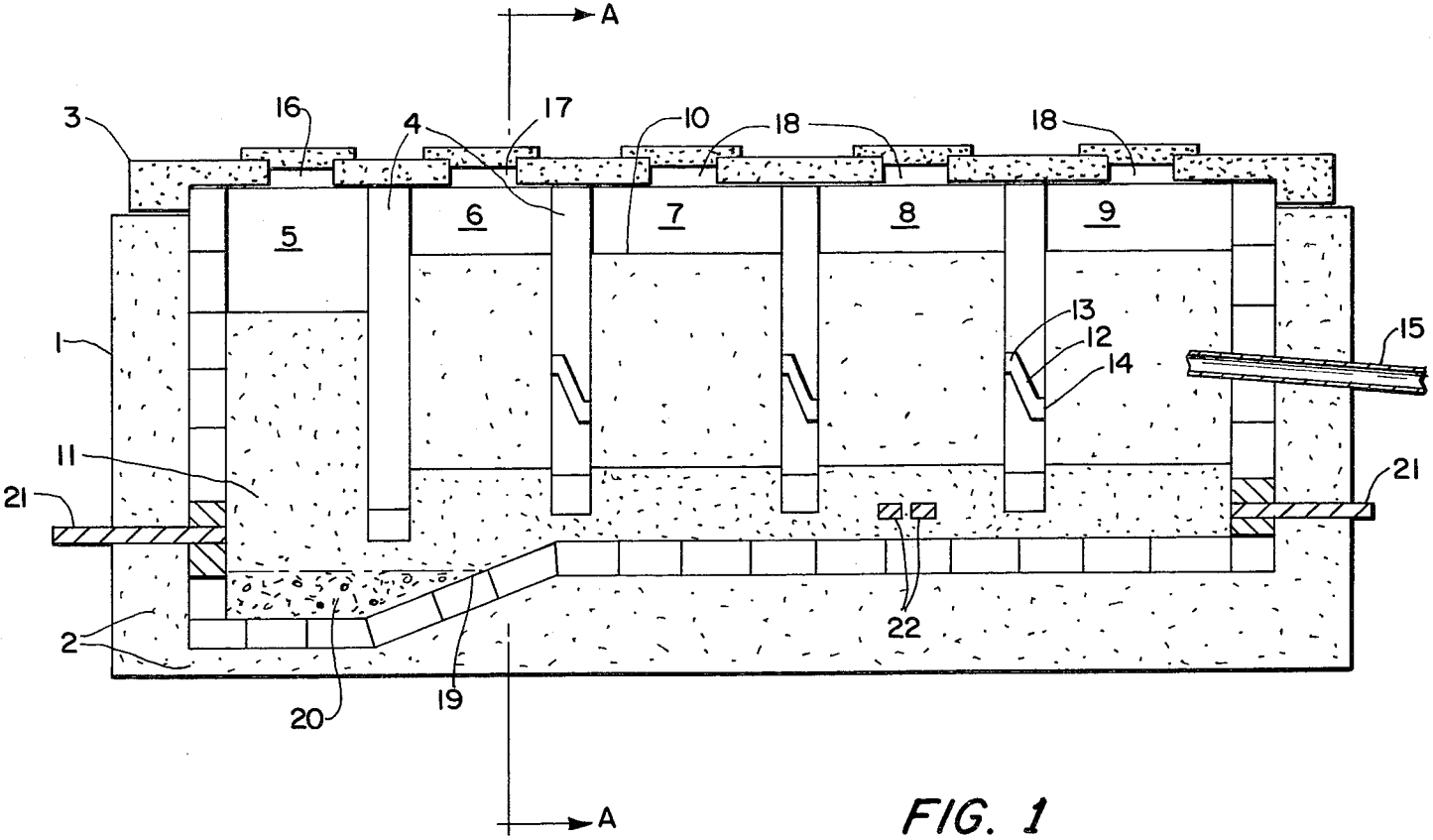
FIG. 1: is a vertical cross section taken along a refining furnace.

FIG. 1 shows a sectional view taken along the refining furnace. The furnace comprises a rectangular body (1) provided with refractory lining (2) in bottom and side walls. A thermal insulated roof or lid (3) is attached to the furnace top and a plurality of adjacent partition walls (4) divide the furnace into an accumulating chamber (5) for sludge and several consecutively arranged precipitation chambers (6, 7, 8, 9).

The partition walls extend below the metal level (10) in the furnace, but are arranged to be spaced a certain distance from the bottom of the furnace in such way that all chambers are in communication with each other through a layer of salt melt (11) which lays beneath the metal. Those partition walls between adjacent precipitation chambers are additionally provided with openings (12) which secure a successive transfer of the metal from the first chamber (6) to the last chamber (9). The openings are designed as skewed channels with inlet (13) located at a higher level than outlet (14) in the following chamber. The furnace lid is provided with an opening (17) for charging of magnesium to the furnace, an opening (16) for removal of sludge (20) from the accumulating chamber and an opening (18) for each of the consecutively arranged precipitation chambers for the cleaning of the chambers under periodical revisions of the furnace. All these openings are provided with cover means in order to keep the chambers closed during the refining process.

A bottom part (19) under the chamber (6) where magnesium is charged slopes downwardly to the accumulating chamber. The last of the precipitation chambers (9) is provided with an outlet (15) for the continuous discharging of the refined magnesium. Alternatively, a discontinuous tapping of magnesium through the opening (18) in the furnace lid above chamber (19) can take place.

The furnace walls are provided with a set of electrodes (21) which provides possibility of heating up the salt layer (11) in connection with a break in performance or at the start up of the furnace. Additionally another set of electrodes (22) can be used for the regulation of the temperature of the refined magnesium leaving the furnace. The furnace also can be provided with measurement electrodes for determination of height of the salt layer (not shown in the drawings).

Figure 2:
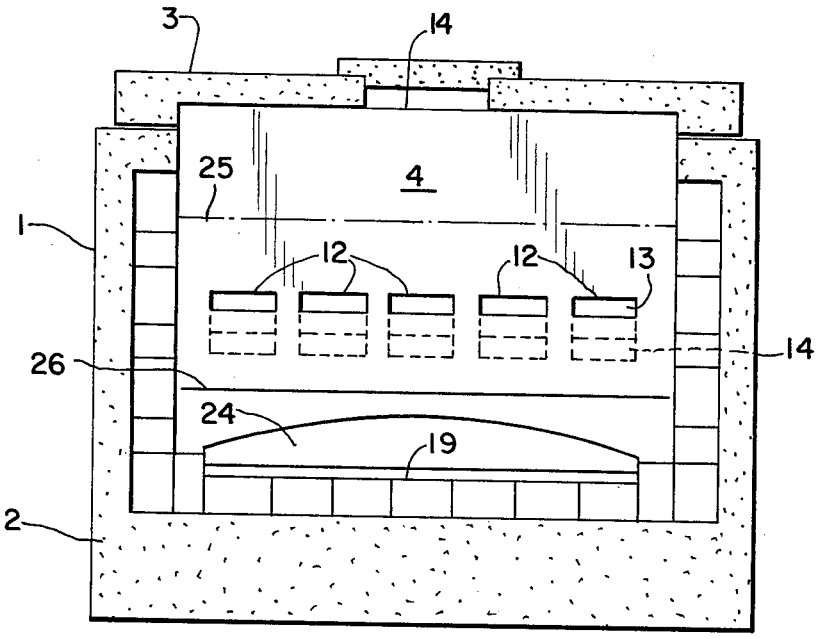
FIG. 2: is a sectional view along the line A—A in FIG. 1.

FIG. 2 shows a sectional view of chamber (6) taken along the line A—A in FIG. 1. The partition wall (4) in the refining furnace (1), with refractory lining (2) and heat insulating lid (3), is provided with openings (12) for transfer of the metal to the next chamber in the process direction.

The inlet (13) is located at a higher level than the outlet (14) in the next chamber. The lines (25) and (26) indicate respectively metal and salt levels in the furnace. An opening (24) between the lower surface of the partition wall (4) and the furnace bottom (19) provides a connection between precipitation chambers beneath the melt level (26). The magnesium to be refined is charged into the furnace through the opening (17) in the furnace lid.

The refining of magnesium takes place in the following manner:

The furnace is charged with melted salts (11) of the type which are used in electrolysis cells for magnesium production. The cover means in the furnace lid (3) are closed and a protective gas is supplied to the furnace by a gas conduit (not shown in the drawings). The salt melt is heated up by means of the electrodes (21) prior to the charging of molten magnesium through opening (17) in the furnace lid. Magnesium is gradually build up in the precipitation chambers (6, 7, 8, 9) by a successive overflowing from chamber to chamber in the process direction through openings (12) in partition walls (4). The salt melt diminishes in these chambers and gradually fills the accumulating chamber (5) which always only contains salt melt and no magnesium.

There are different practical ways for the transport of magnesium to the refining furnace. Regardless of whether the transfer is achieved continuously or batchwise, e.g. from tapping- or transport crucibles, it is important to bring the magnesium to the chamber as a stream directed toward the underlying salt layer (11). In this manner, most of the supplied sludge is retained in the first precipitation chamber, falls to the bottom and slides along the sloped bottom (19) of the chamber to the adjacent accumulating chamber (5). From this accumulating chamber, the sludge can be removed without interrupting the refining process or causing metal oxidation through the opening (16) in the lid.

The principle of a low settling path for the precipitated oxide particles is also used during the metal transport through the precipation chambers as a result of the special design of openings (12) in the partition walls (4). It is always the purest metal from the upper layer in the upstream precipitation chamber which is transferred to the lower metal layer in the next downstream chamber. Also, the shape of the openings itself and their location along the partition walls result in low transfer velocities without turbulence in the metal.

CAPACITY EXAMPLE

A furnace with a total length of the precipitation chambers of 2.7 m, a chamber height of 1.28 m and with a total area of the openings per partition wall of 0.1 $m^2$ was run continuously for several weeks with the following typical load:

Raw magnesium charged in: 3.36 t/h

Pure magnesium removed (casted): 3.1 t/h

This gives a productivity of approximately 80 t raw metal per day at a relatively moderate size of the furnace. Sludge was removed discontinuously from the accumulating chamber and it was not necessary to clean the precipitation chambers during the test period.

The furnace as shown in FIGS. 1 and 2 described in the foregoing, represents only one embodiment of a refining furnace for use for the practical performance of the method according to the invention.

Various number of precipitation chambers, different locations and areas of the openings in the partition walls and other constructive modifications can be employed within the scope of the invention for the continuous refining of magnesium.

We claim:

1. A furnace for the continuous refining of molten magnesium by the precipitation therefrom of impurities as sludge, said furnace comprising:

a furnace body having a refractory lining defining a furnace interior in the bottom of which is a layer of molten salt;

a plurality of vertical partition walls dividing said furnace interior into a sludge accumulation chamber and a plurality of successively arranged precipitation chambers, bottom ends of said walls being spaced from the bottom of said furnace lining at a level beneath the upper surface of said molten salt, said precipitation chambers adapted to contain molten magnesium above said upper surface of said molten salt, and said accumulation chamber adapted to be free of molten magnesium;

means for charging molten magnesium to be refined into a first said precipitation chamber adjacent said accumulation chamber, such that said charged molten magnesium is directed below the surface of the molten magnesium in said first precipitation chamber toward said molten salt, whereby impurities in the charged molten magnesium are precipitated downwardly through said molten salt, and the charged molten magnesium rises upwardly within said first precipitation chamber;

the bottom of said first precipitation chamber being inclined downwardly toward said accumulation chamber, such that said precipitated impurities are directed downwardly along said inclined bottom and into said accumulation chamber; and each said partition wall between two adjacent said precipitation chambers having means for sequentially transferring said molten magnesium in a processing direction from said first precipitation chamber into and through the remainder of said successively arranged precipitation chambers in a manner such that, during each transfer between adjacent said precipitation chambers, molten magnesium at a relatively upper level in the upstream said precipitation chamber is introduced at a relatively lower level into the downstream said precipitation chamber, said transferring means comprising at least one skewed channel through the respective said partition wall, each said channel having an inlet from the respective upstream precipitation chamber and an outlet into the respective downstream precipitation chamber, said inlet being at a level higher than said outlet, whereby any impurities remaining in the molten magnesium in each said precipitation chamber downstream of said first precipitation chamber precipitate therefrom to the molten salt therein.

2. A furnace as claimed in claim 1, wherein said precipitation chambers are successively arranged in a longitudinal said processing direction.

3. A furnace as claimed in claim 1, further comprising a furnace roof above said chambers, said roof having therein selectively closeable openings communicating with each of said chambers.

4. A furnace as claimed in claim 1, further comprising means for removing refined molten magnesium from the downstreammost said precipitation chamber.

5. A furnace as claimed in claim 1, wherein each said partition wall has therein plural said skewed channels.

6. A method for the continuous refining of molten magnesium by the precipitation therefrom of impurities as sludge, said method comprising:

providing a furnace including a furnace body having a refractory lining defining a furnace interior in the bottom of which is a layer of molten salt, and a plurality of partition walls dividing the furnace interior into a sludge accumulation chamber and a plurality of successively arranged precipitation chambers, with bottom ends of said walls being spaced from the bottom of said furnace lining at a level beneath the upper surface of said molten salt, said precipitation chambers adapted to contain molten magnesium above said upper surface of said molten salt, and said accumulation chamber being free of molten magnesium;

charging molten magnesium to be refined into a first said precipitation chamber adjacent said accumulation chamber, such that said charged molten magnesium is directed below the surface of the molten magnesium in said first precipitation chamber toward said molten salt, whereby impurities in said charged molten magnesium precipitate downwardly through said molten salt, and said charged molten magnesium rises upwardly within said first precipitation chamber;

directing said precipitated impurities as sludge downwardly from said first precipitation chamber along an inclined bottom thereof into said accumulation chamber; and sequentially transferring said molten magnesium in a processing direction from said first precipitation chamber into and through the remainder of said successively arranged precipitation chambers in a manner such that, during each transfer between adjacent said precipitation chambers, molten magnesium at a relatively upper level in the upstream said precipitation chamber is introduced at a relatively lower level into the downstream said precipitation chamber, whereby any impurities remaining in the molten magnesium in each said precipitation chamber downstream of said first precipitation chamber precipitate therefrom to the molten salt therein.

7. A method as claimed in claim 6, wherein said transferring comprises, for said each transfer, passing said molten metal from said upstream precipitation chamber to said downstream precipitation chamber through at least one skewed channel extending through the respective said partition wall therebetween, said channel having an inlet from said upstream precipitation chamber and an outlet into said downstream precipitation chamber, said inlet being at a level higher than said outlet.

8. A method as claimed in claim 6, comprising transferring said molten magnesium through said successively arranged precipitation chambers in a longitudinal said processing direction.

9. A method as claimed in claim 6, further comprising removing refined molten magnesium from the downstreammost said precipitation chamber.

* * * * *